US009916790B2

(12) United States Patent
Kim

(10) Patent No.: US 9,916,790 B2
(45) Date of Patent: Mar. 13, 2018

(54) ORGANIC LIGHT EMITTING DISPLAY DEVICE AND DRIVING METHOD THEREOF

(71) Applicant: Samsung Display Co., Ltd., Yongin (KR)

(72) Inventor: Jin-Woo Kim, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 443 days.

(21) Appl. No.: 14/722,235

(22) Filed: May 27, 2015

(65) Prior Publication Data

US 2016/0055831 A1 Feb. 25, 2016

(30) Foreign Application Priority Data

Aug. 22, 2014 (KR) ..... 10-2014-0109729

(51) Int. Cl.

| | |
|---|---|
| ***G09G 5/18*** | (2006.01) |
| ***G09G 3/32*** | (2016.01) |
| ***G09G 3/3283*** | (2016.01) |
| ***G09G 3/3208*** | (2016.01) |

(52) U.S. Cl.

CPC ..... *G09G 3/3283* (2013.01); *G09G 3/3208* (2013.01); *G09G 2320/0223* (2013.01); *G09G 2320/0233* (2013.01); *G09G 2320/0285* (2013.01); *G09G 2330/02* (2013.01); *G09G 2360/16* (2013.01)

(58) Field of Classification Search

CPC ..... G09G 3/3283; G09G 3/3208; G09G 2360/16; G09G 2330/02; G09G 2320/0285; G09G 2320/0223; G09G 2320/0233

See application file for complete search history.

(56) References Cited

U.S. PATENT DOCUMENTS

| | | | | |
|---|---|---|---|---|
| 8,405,582 | B2 * | 3/2013 | Kim | G09G 3/3233 315/169.3 |
| 8,593,378 | B2 * | 11/2013 | Ryu | G09G 3/3233 315/169.3 |
| 2007/0046587 | A1 | 3/2007 | Takahara | |
| 2008/0158218 | A1 | 7/2008 | Kim | |
| 2009/0027315 | A1 | 1/2009 | Kim et al. | |
| 2013/0002960 | A1 | 1/2013 | Ryu et al. | |
| 2014/0160142 | A1 * | 6/2014 | Lee | G09G 3/3208 345/589 |

FOREIGN PATENT DOCUMENTS

| | | |
|---|---|---|
| KR | 10-2007-0026711 | 3/2007 |
| KR | 10-0830298 | 5/2008 |
| KR | 10-2009-0011702 | 2/2009 |
| KR | 10-2013-0002118 | 1/2013 |

* cited by examiner

*Primary Examiner* — Andrew Sasinowski

(74) *Attorney, Agent, or Firm* — H.C. Park & Associates, PLC

(57) ABSTRACT

An organic light emitting display device includes: a panel having sections and blocks, pixels included in the blocks to control an amount of current flowing from a first power source to a second power source via organic light emitting diodes; a data driver to receive data, and generate the data signals; a sensing unit connected to the power supply unit, and to detect an amount of current flowing in each of the blocks; and a timing controller to generate a correction value to adjust the data in view of the amount of current.

20 Claims, 7 Drawing Sheets

430

| | | | | | | | |
|---|---|---|---|---|---|---|---|
| 32 | 33 | 34 | 35 | 36 | 37 | 38 | 39 |
| 24 | 25 | 26 | 27 | 28 | 29 | 30 | 31 |
| 16 | 17 | 18 | 19 | 20 | 21 | 22 | 23 |
| 8 | 9 | 10 | 11 | 12 | 13 | 14 | 15 |
| RB | 1 | 2 | 3 | 4 | 5 | 6 | 7 |
| 40 | 41 | 42 | 43 | 44 | 45 | 46 | 47 |
| 48 | 49 | 50 | 51 | 52 | 53 | 54 | 55 |
| 56 | 57 | 58 | 59 | 60 | 61 | 62 | 63 |
| 64 | 65 | 66 | 67 | 68 | 69 | 70 | 71 |

ORGANIC LIGHT EMITTING DISPLAY DEVICE AND DRIVING METHOD THEREOF

CROSS-REFERENCE TO RELATED APPLICATION

This application claims priority from and the benefit of Korean Patent Application No. 10-2014-0109729, filed on Aug. 22, 2014, which is hereby incorporated by reference for all purposes as if fully set forth herein.

BACKGROUND

Field

Exemplary embodiments relate to an organic light emitting display device and a driving method thereof.

Discussion of the Background

According to development of information technology, importance of a display device, which is a connection medium between a user and information, has increased. In response to this, use of a flat panel display device (e.g., a liquid crystal display device, an organic light emitting display device, and a plasma display panel) has increased.

The organic light emitting display device among the flat panel display devices displays an image by using an organic light emitting diode in which light is generated through recombination of electrons and holes, and has an advantage in that the organic light emitting display device has a fast response speed and is driven with low power consumption.

The organic light emitting display device in a related art generally includes a plurality of pixels arranged in a matrix form in crossing parts of a plurality of data lines, a plurality of scan lines, and a power supply line. The pixels generally include organic light emitting diodes, and driving transistors for controlling amount of currents flowing to the organic light emitting diodes. The driving transistor controls an amount of current flowing from the first power source to the second power source via the organic light emitting diode and controls luminance of light generated by the organic light emitting diode. However, such organic light emitting display device cannot display a uniform image due to deterioration of the organic light emitting diodes and the driving transistors according to a passage of time.

The above information disclosed in this Background section is only for enhancement of understanding of the background of the inventive concept, and, therefore, it may contain information that does not form the prior art that is already known in this country to a person of ordinary skill in the art.

SUMMARY

Exemplary embodiments provide an organic light emitting display device, which is capable of displaying an image with uniform luminance, and a driving method thereof.

Additional aspects will be set forth in the detailed description which follows, and, in part, will be apparent from the disclosure, or may be learned by practice of the inventive concept.

Exemplary embodiments of the present invention provide an organic light emitting display device including: a panel divided into a plurality sections, in which each section includes a plurality of blocks, each block includes a plurality of pixels, and the pixels are configured to control an amount of current flowing from a first power source to a second power source via organic light emitting diodes; a data driver configured to receive bits of data, and generate data signals in response to the bits of data; a sensing unit connected to the power supply unit, and configured to detect an amount of current flowing in each of the blocks; and a timing controller configured to generate a correction value to adjust bits of data in view of the amount of current.

Exemplary embodiments of the present invention provide a method of driving an organic light emitting display device including: a panel, which is divided into sections including a plurality blocks, the blocks including one or more pixels, the method including: setting a block among the blocks as a reference block and measuring an amount of current flowing in the reference block; measuring an amount of current flowing in a target block adjacent to the reference block; determining whether the amount of current flowing in the target block satisfies a section data range including an allowable current deviation between the sections, and an adjacent data range including an allowable current deviation between the target blocks and the reference blocks, in which, when the amount of current flowing in the target block does not satisfy at least one of the section data range and the adjacent data range, generating a correction value to adjust the amount of current flowing in the target block to satisfy the section data range and the adjacent data range.

Exemplary embodiments of the present invention provide a method of driving an organic light emitting display device including a panel, which has a plurality of blocks including one or more pixels, the method including: setting a block among the blocks as a reference block and measuring an amount of current flowing in the reference block; measuring an amount of current flowing in a first block spaced apart from the reference block in a first direction, the reference block disposed adjacent to the first block; measuring an amount of current flowing in a second block spaced apart from the reference block in a second direction different from the first direction, the reference block disposed adjacent to the second block; determining whether the amount of currents flowing in the first block and the second block satisfy an adjacent data range including an allowable current deviation between adjacent blocks; and when the amount of current of at least one of the first block and the second block does not satisfy the adjacent data range, correcting the amount of current of the at least one of the first block and the second block by generating a correction value and adjusting the current of the at least one of the first block and the second block to satisfy the adjacent data range.

It is to be understood that both the foregoing general description and the following detailed description are exemplary and explanatory and are intended to provide further explanation of the invention as claimed. Other features and aspects will be apparent from the following detailed description, the drawings, and the claims.

BRIEF DESCRIPTION OF THE DRAWINGS

The accompanying drawings, which are included to provide a further understanding of the inventive concept, and are incorporated in and constitute a part of this specification, illustrate exemplary embodiments of the inventive concept, and, together with the description, serve to explain principles of the inventive concept.

DETAILED DESCRIPTION OF THE ILLUSTRATED EMBODIMENTS

Figure 1:
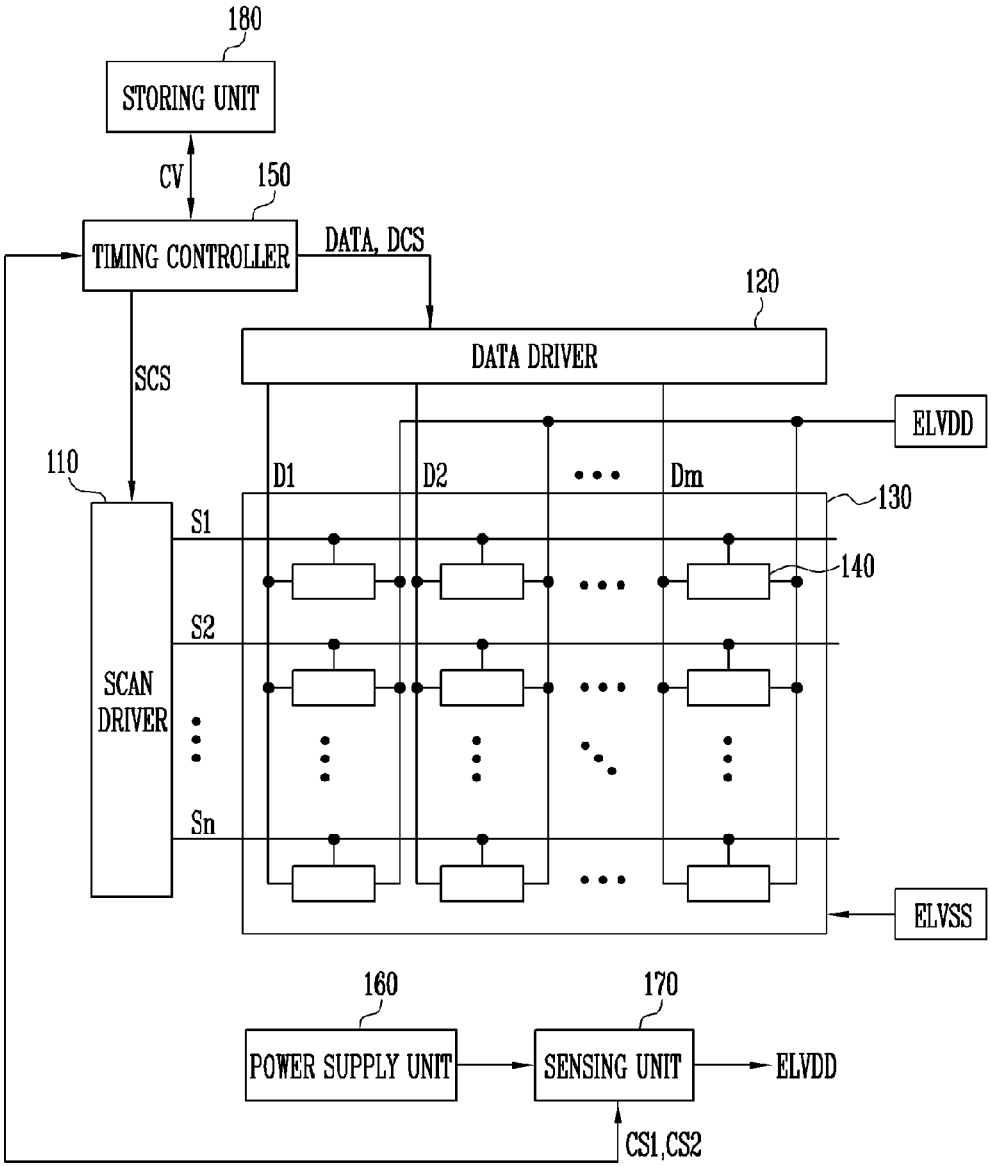
FIG. 1 is a diagram illustrating an organic light emitting display device according to an exemplary embodiment of the present invention.

In the following description, for the purposes of explanation, numerous specific details are set forth in order to provide a thorough understanding of various exemplary embodiments. It is apparent, however, that various exemplary embodiments may be practiced without these specific details or with one or more equivalent arrangements. In other instances, well-known structures and devices are shown in block diagram form in order to avoid unnecessarily obscuring various exemplary embodiments.

In the accompanying figures, the size and relative sizes of layers, films, panels, regions, etc., may be exaggerated for clarity and descriptive purposes. Also, like reference numerals denote like elements.

When an element or layer is referred to as being "on," "connected to," or "coupled to" another element or layer, it may be directly on, connected to, or coupled to the other element or layer or intervening elements or layers may be present. When, however, an element or layer is referred to as being "directly on," "directly connected to," or "directly coupled to" another element or layer, there are no intervening elements or layers present. For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. Like numbers refer to like elements throughout. As used herein, the term "and/or" includes any and all combinations of one or more of the associated listed items.

Although the terms first, second, etc. may be used herein to describe various elements, components, regions, layers, and/or sections, these elements, components, regions, layers, and/or sections should not be limited by these terms. These terms are used to distinguish one element, component, region, layer, and/or section from another element, component, region, layer, and/or section. Thus, a first element, component, region, layer, and/or section discussed below could be termed a second element, component, region, layer, and/or section without departing from the teachings of the present disclosure.

Spatially relative terms, such as "beneath," "below," "lower," "above," "upper," and the like, may be used herein for descriptive purposes, and, thereby, to describe one element or feature's relationship to another element(s) or feature(s) as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath" other elements or features would then be oriented "above" the other elements or features. Thus, the exemplary term "below" can encompass both an orientation of above and below. Furthermore, the apparatus may be otherwise oriented (e.g., rotated 90 degrees or at other orientations), and, as such, the spatially relative descriptors used herein interpreted accordingly.

The terminology used herein is for the purpose of describing particular embodiments and is not intended to be limiting. As used herein, the singular forms, "a," "an," and "the" are intended to include the plural forms as well, unless the context clearly indicates otherwise. Moreover, the terms "comprises," comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof.

Various exemplary embodiments are described herein with reference to sectional illustrations that are schematic illustrations of idealized exemplary embodiments and/or intermediate structures. As such, variations from the shapes of the illustrations as a result, for example, of manufacturing techniques and/or tolerances, are to be expected. Thus, exemplary embodiments disclosed herein should not be construed as limited to the particular illustrated shapes of regions, but are to include deviations in shapes that result from, for instance, manufacturing. For example, an implanted region illustrated as a rectangle will, typically, have rounded or curved features and/or a gradient of implant concentration at its edges rather than a binary change from implanted to non-implanted region. Likewise, a buried region formed by implantation may result in some implantation in the region between the buried region and the surface through which the implantation takes place. Thus, the regions illustrated in the drawings are schematic in nature and their shapes are not intended to illustrate the actual shape of a region of a device and are not intended to be limiting.

Unless otherwise defined, all terms (including technical and scientific terms) used herein have the same meaning as commonly understood by one of ordinary skill in the art to which this disclosure is a part. Terms, such as those defined in commonly used dictionaries, should be interpreted as having a meaning that is consistent with their meaning in the context of the relevant art and will not be interpreted in an idealized or overly formal sense, unless expressly so defined herein.

Figure 2:
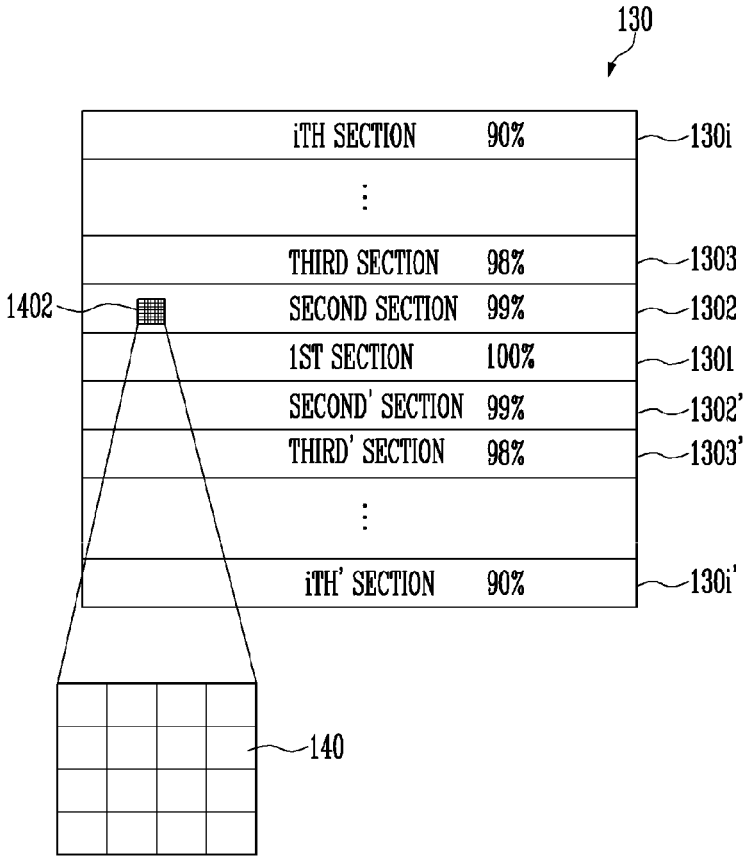
FIG. 2 is a diagram illustrating sections and blocks set in a panel of FIG. 1.

FIG. 1 is a diagram illustrating an organic light emitting display device according to an exemplary embodiment of the present invention. FIG. 2 is a diagram illustrating sections and blocks set in a panel of FIG. 1.

Referring to FIG. 1, an organic light emitting display device includes a panel 130 including pixels 140 positioned in regions divided by scan lines S1 to Sn and data lines D1 to Dm, a scan driver 110 for driving the scan lines S1 to Sn, and a data driver for driving data lines D1 to Dm.

Further, the organic light emitting display device includes a power supply unit 160, a sensing unit 170 connected to the power supply unit 160, a storing unit, and a timing controller 150. The power supply unit 160 may supply a first power source ELVDD. The sensing unit 170 may detect an amount of current flowing by the first power source ELVDD. The storing unit 180 may store a correction value in response to the amount of current detected by the sensing unit 170. The timing controller 150 may control at least one of the scan driver 110, the data driver 120, the sensing unit 170, and the storing unit 180.

A plurality of pixels 140 is formed on the panel 130. One or more of the pixels 140 may generate light with predetermined luminance while controlling an amount of current flowing from the first power source ELVDD to the second power source ELVSS via an organic light emitting diode (not illustrated) in response to a data signal.

According an exemplary embodiment, the panel 130 may be divided into a plurality of sections 1301 to 130*i*, and 1302' to 130*i*' as exemplified in FIG. 2. For example, an upper part of the panel 130 may be divided into a first section 1301 to an $i^{th}$ section 130*i*, and a lower part of the panel 130 may be divided into a first section 1301 to an $i^{th}$ section 130*i*'. The first section 1301 may be positioned at a central or middle region of the panel 130.

One or more of the sections 1301 to 130*i*', and 1302' to 130*i*' positioned in the panel 130 may include a plurality of blocks 1402. One or more of the blocks 1402 may be divided to include one or more pixels 140. A block may refer to a reference unit or minimum unit for correcting a current value.

At least one reference block may be included in the first section 1301. In an example, amount of current flowing in the reference block may be set as 100%, and a current may be corrected in adjacent blocks based on the set amount of current. In the second section 1302, a section data range may be set to have a predetermined range above and below in the amount of current of 100% flowing in the reference block. The predetermined range may be variously set in consideration of at least one of a resolution, size, and the like of the panel 130. For example, the section data range of the first section 1301 may be set to have a current range of 100%±3%, more specifically, 103% to 97%.

Further, the section data range may be set to be decreased from the first section 1301 to the upper sections 1302 to 130*i* and the lower sections 1302' to 130*i*' in consideration of at least one of a resistance, voltage drop, and the like. For example, in the second sections 1302 and 1302', the section data range may be set to have a current range of 99%±3%, more specifically, 102% to 96%. Further, in the third sections 1303 and 1303', the section data range may be set to have a current range of 98%±3%, more specifically, 101% to 95%. The section data ranges of the remaining sections may be set by the similar method.

The timing controller 150 may generate a scan driving control signal SCS, a data driving control signal DCS, a first control signal CS1, and a second control signal CS2 in response to synchronization signals (not illustrated) supplied from the outside. The scan driving control signal SCS generated by the timing controller 150 may be supplied to the scan driver 110. The data driving control signal DCS may be supplied to the data driver 120. The first control signal CS1 and the second control signal CS2 may be supplied to the sensing unit 170. Further, the timing controller 150 may generate a correction value CV in response to an amount of current in the unit of a block detected by the sensing unit 170 for a sensing period of time, and supply the generated correction value CV to the storing unit 180. The timing controller 150 may change data DATA in the unit of the block in response to the correction value CV for a normal driving period of time, and supply the changed data DATA to the data driver 120.

The scan driver 110 may supply a scan signal to the scan lines S1 to Sn in response to the scan driving control signal SCS. The scan driver 110 may sequentially supply the scan signal to the scan lines S1 to Sn for the normal driving period of time. Further, the scan driver 110 may supply the scan signal in block units for the sensing period of time. For example, when an amount of current is extracted from a specific block, and the pixels included in the specific block are connected to $k^{th}$, $k+1^{th}$, $k+2^{th}$, and $k+3^{th}$ scan lines (k is a natural number), the scan driver 110 may sequentially supply the scan signal to the $k^{th}$, $k+1^{th}$, $k+2^{th}$, and $k+3^{th}$ scan lines.

The data driver 120 may supply a data signal to the data lines D1 to Dm in response to the data driving control signal DCS. The data driver 120 may supply the data signal corresponding to an image to be displayed for the normal driving period of time. Further, the data driver 120 may supply a specific data signal corresponding to a predetermined grayscale to all of the pixels 140 for the sensing period of time. The specific data signal may be variously set as a voltage at which a predetermined current may flow.

The power supply unit 160 may generate the first power source ELVDD, and supply the generated first power source ELVDD to the pixels 140. Although only the first power source ELVDD is illustrated as being generated by the power supply unit 160, aspects of the invention are not limited thereto, such that the power supply unit 160 may generate various voltages including the second power source ELVSS, in addition to the first power source ELVDD.

The sensing unit 170 is positioned between the power supply unit 160 and the pixels 140. The sensing unit 170 may supply the voltage of the first power source ELVDD to the pixels 140 for the sensing period of time, and simultaneously detect an amount of current flowing in the block unit. The amount of current in the block unit detected by the sensing unit 170 may be supplied to the timing controller 150. Further, the sensing unit 170 may supply the first power source ELVDD from the power supply unit 160 to the pixels 140 for the normal driving period of time.

Figure 3:
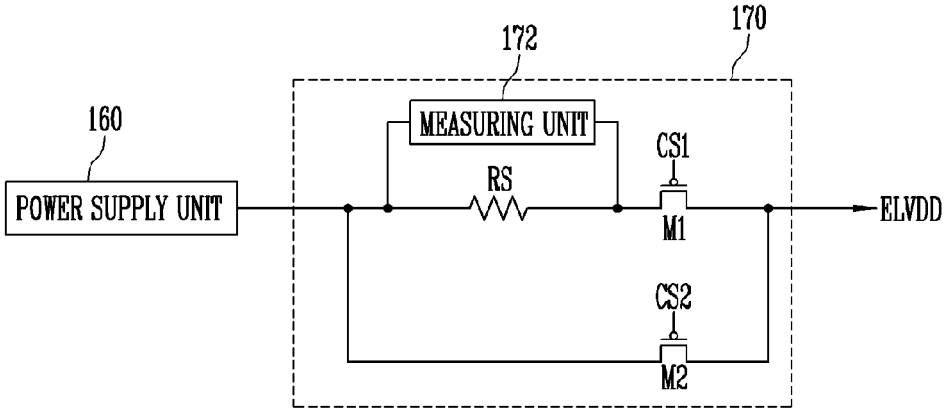
FIG. 3 is a diagram illustrating a sensing unit according to an exemplary embodiment of the present invention.

FIG. 3 is a diagram illustrating a sensing unit according to an exemplary embodiment of the present invention.

Referring to FIG. 3, the sensing unit 170 includes a sensing resistor RS and a first transistor M1 serially connected between the power supply unit 160 and the pixels 140, a measuring unit 172 positioned at both ends of the sensing resistor RS, and a second transistor M2 connected in parallel with the sensing resistor RS and the first transistor M1, and between the power supply unit 160 and the pixels 140. The measuring unit 172 may measure an amount of current passing through the sensing resistor RS.

The first transistor M1 may be turned on in response to the first control signal CS1 for the sensing period of time. When the first transistor M1 is turned on, the voltage of the first power source ELVDD may be supplied to the pixels 140 via the sensing resistor RS.

The sensing resistor RS is positioned between the first transistor M1 and the power supply unit 160. The sensing resistor RS may be set to have a reference resistance sufficient for measuring an amount of current flowing in the block unit.

The measuring unit 172 is connected to both ends of the sensing resistor RS, and may measure an amount of current flowing to the sensing resistor RS. The amount of current measured by the measuring unit 172 may be supplied to the timing controller 150.

The second transistor M2 may be turned on in response to the second control signal CS2 for the normal sensing period of time. When the second transistor M2 is turned on, the voltage of the first power source ELVDD may be supplied to the pixels 140 via the sensing resistor RS.

Figure 4:
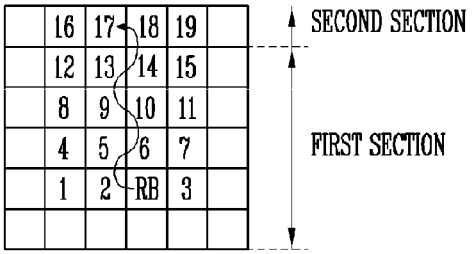
FIG. 4 is a diagram illustrating a process of generating a correction value for a sensing period of time according to an exemplary embodiment of the present invention.
Figure 4:
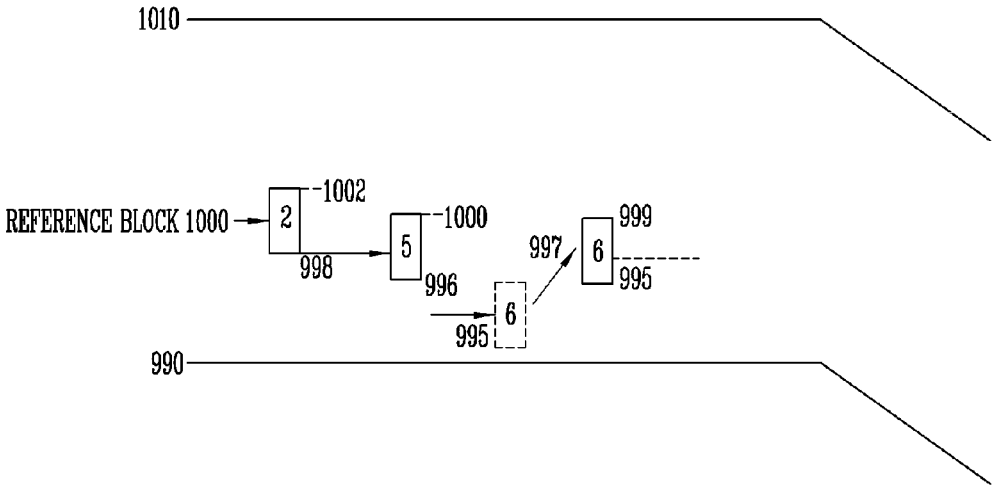

FIG. 4 is a diagram illustrating a process of generating a correction value for the sensing period of time according to an exemplary embodiment of the present invention.

Referring to FIG. 4, a specific data signal may be first supplied to a reference block RB for the sensing period of time, and the sensing unit 170 may measure an amount of current flowing to the reference block RB. In an example, the amount of current flowing to the reference block RB may be 1,000, and the section data range of the first section 1301 may be set as 1,010 to 990 by applying ±1% to the amount of current of 1,000. Further, an adjacent data range may be set as 1,002 to 998 by applying ±0.2% to the amount of current of 1,000.

According to aspects of the invention, the section data range may refer to or include a current deviation allowable between the sections, and the adjacent data range may refer to or include a current deviation allowable between adjacent blocks. The adjacent data range may be set to have a lower range than the section data range.

After the amount of current of the reference block RB is measured, an amount of current of a second block may be measured. When the amount of current measured in the second block is 998, it may be determined that the amount of current satisfies the section data range and the adjacent data range. An amount of current of a fifth block may be measured based on the amount of current of the second block. When the amount of current measured in the fifth block is set as 995, the amount of current may not satisfy the adjacent data range. In this case, the timing controller 150 may generate a correction value CV so that the amount of current flowing in the fifth block may satisfy the adjacent data range.

More particularly, the timing controller 150 may generate a correction value CV so that a bit of data DATA supplied to the fifth block may be changed. The amount of current flowing in the fifth block may be determined to satisfy the section data range and the adjacent data range in response to the generated correction value CV. For example, when the amount of current of 997 flows in the fifth block, the amount of current flowing in the fifth block may be determined to satisfy the section data range and the adjacent data range, and the correction value CV may be stored in the storing unit 180.

It may be determined whether an amount of current of a tenth block satisfies the section data range and the adjacent data range based on the amount of current of 997 of the sixth block. More specifically, aspects of the invention may generate a correction value for one or more block so that light with similar luminance may be generated with the adjacent block and between the sections while repeating the aforementioned process.

Figure 5A:
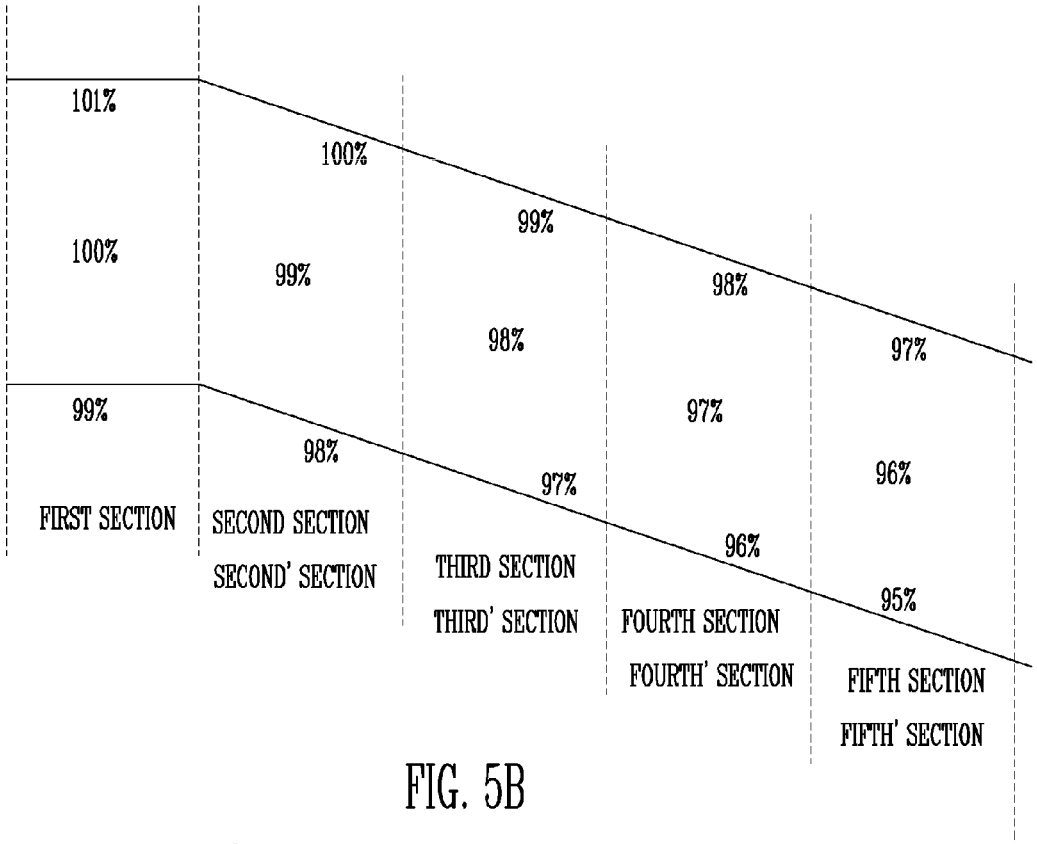
FIGS. 5A and 5B are diagrams illustrating a section data range and a compensation process in response to the section data range according to an exemplary embodiment of the present invention.
Figure 5B:
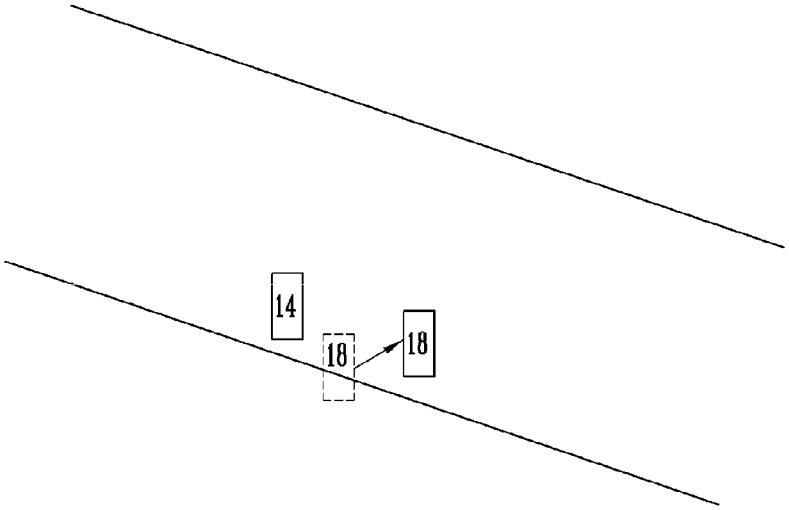

Referring to FIG. 5A, the section data range may gradually decrease based on a section's distance from the first section. Referring to FIG. 5B, when an amount of current flowing in an $18^{th}$ block, which is adjacent to a $14^{th}$ block, satisfies the adjacent data range but not the section data range, the timing controller 150 may generate a correction value CV so that amount of current flowing in the $18^{th}$ block satisfies the section data range. Further, the generated correction value CV may be stored in the storing unit 180.

According to aspects of the invention, a luminance deviation between the sections may be reduced or minimized by using the section data range, and a luminance deviation between the adjacent blocks may be reduced or minimized by using the adjacent data range. The timing controller 150 may change a bit of the data supplied to the block, in which the correction value CV may be generated, by using the correction value CV for the normal driving period of time. Further, the timing controller 150 may supply the changed data to the data driver 120. Then, the panel 130 may implement an image with uniform luminance regardless of deterioration and the like.

Figure 6:
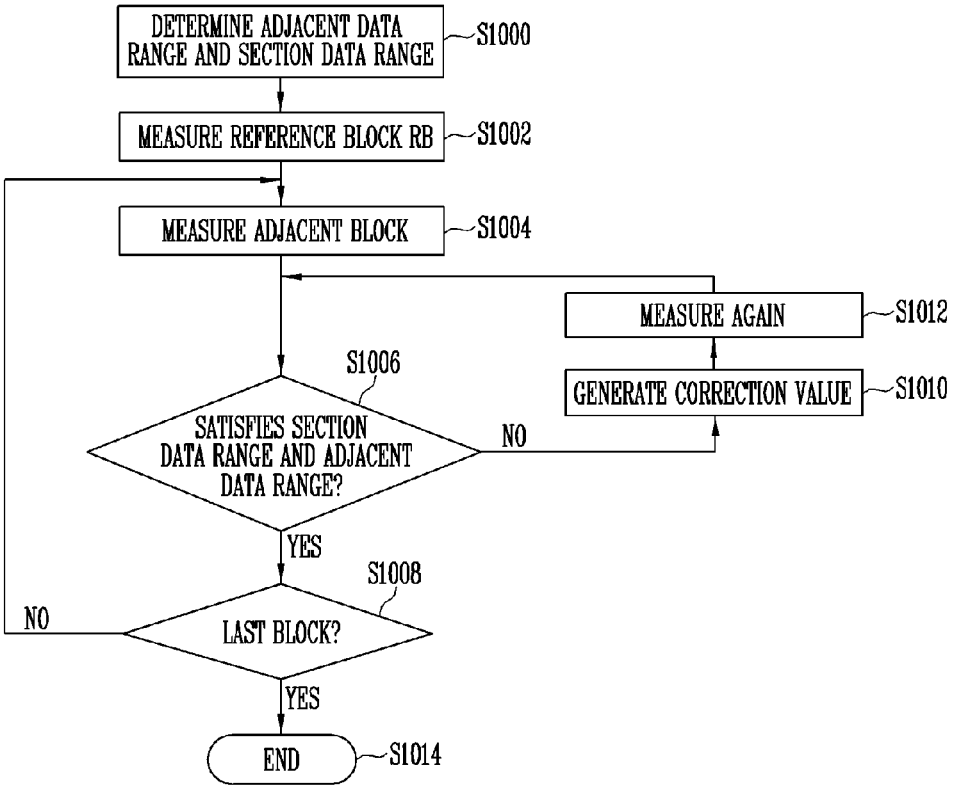
FIG. 6 is a flowchart illustrating a driving method of the organic light emitting display device according to an exemplary embodiment of the present invention.

FIG. 6 is a flowchart illustrating a driving method of the organic light emitting display device according to an exemplary embodiment of the present invention. Although the method of FIG. 6 is described as being performed by the organic light emitting display device of FIG. 1, aspects of the invention are not limited thereto.

Referring to FIG. 6, in operation S1000, an adjacent data range and a section data range are first determined considering at least one of a resolution of the panel 130, size of the panel 130, size of a block and size of a section. In operation S1002, a specific data signal may be supplied to a reference block RB from the data driver 120, and the sensing unit 170 may measure an amount of current flowing to the reference block RB. In operation S1004, an amount of current of an adjacent block is measured according to a predetermined order. In operation S1006, the timing controller 150 may check or determine whether the measured amount of current of the adjacent block satisfies the section data range and the adjacent data range.

When the measured amount of current of the adjacent block satisfies both the section data range and the adjacent data range in operation S1006, a determination of whether the block, in which the present amount of current is measured, is the last block in operation S1008. When it is determined that the block, in which the present amount of current is measured, is the last block in operation S1008, a sensing period of time ends in operation S1014. When it is determined that the block, in which the present amount of current is measured, is not the last block in operation S1008, a reference block may be set based on the block, in which the present amount of current is measured, and operations S1004 to S1008 are repeated.

When the amount of current of the adjacent block measured in operation S1004 do not satisfy the section data range and the adjacent data range in operation S1006, the amount of current of the adjacent block may be controlled by generating a correction value CV in operation S1010. Operations S1006, S1010, and S1012 may be repeated until the amount of current of the adjacent block satisfies the section data range and the adjacent data range.

According to aspects of the invention, a correction value CV for one or more blocks corresponding to the amount of current may be generated so that the panel 130 is capable of displaying a uniform image while repeating the aforementioned process for the sensing period of time.

Figure 7A:
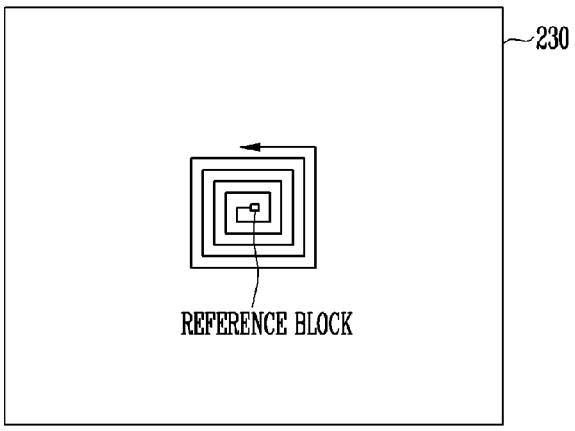
FIGS. 7A and 7B are diagrams illustrating an amount of current measuring order according to an exemplary embodiment of the present invention.
Figure 7B:
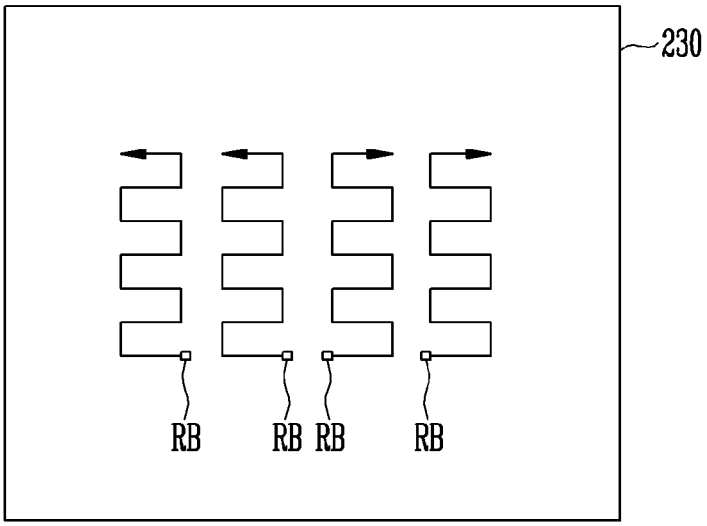

FIGS. 7A and 7B are diagrams illustrating an amount of current measuring order according to exemplary embodiments of the present invention.

Referring to FIGS. 7A and 7B, one reference block RB may be first set at a central region of a panel 230. A current difference between blocks may be detected in a spiral order based on the reference block RB. Further, a plurality of reference blocks RB may be set based on the central region of the panel 230, and a current difference between blocks may be detected in an order in an up direction and a down direction (or a zigzag order) from each reference block RB. However, aspects of the invention are not limited thereto, such that the current measuring order may be set by various methods so that some or all of the blocks included in the panel 230 are selectable.

Figure 8:
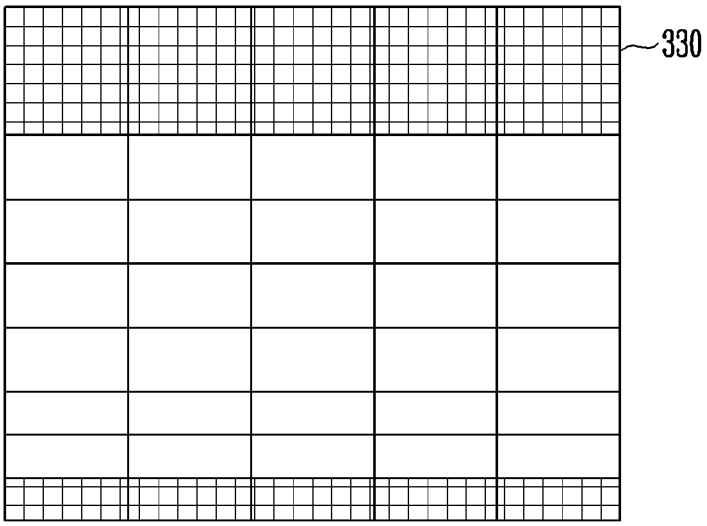
FIG. 8 is a diagram illustrating a block including multiple pixels according to an exemplary embodiment of the present invention.

FIG. 8 is a diagram illustrating a block including a plurality of pixels according to an exemplary embodiment of the present invention.

Referring to FIG. 8, a size of the block may be variously set according to a position of a panel 330. For example, it may be possible to reduce or minimize an amount of current deviation by setting a size of the block to be small in a region in which, deterioration, such as generation of an after image, may occur. Further, it may be possible to decrease an amount of current measuring time by setting a size of the block to be large (e.g., by setting the number of included pixels to be large) in a region in which an after image may not be generated. More specifically, according to aspects of the invention, it may be possible to control the number of pixels included in the blocks to improve the uniformity of the panel 330 and decrease the sensing period of time.

Figures 9, 10:
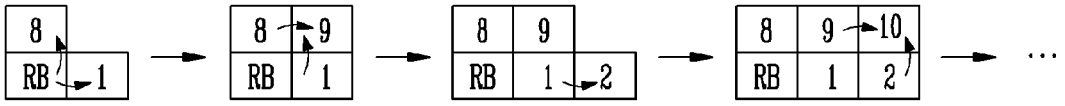
FIG. 9 is a diagram illustrating a panel according to an exemplary embodiment of the present invention.
FIG. 10 is a diagram illustrating an amount of current correcting method in a panel of FIG. 9.

FIG. 9 is a diagram illustrating a panel according to an exemplary embodiment of the present invention.

Referring to FIG. 9, a panel 430 is divided into a plurality of blocks. More specifically, the panel 430 may not be divided into separate sections, and an amount of current deviation may be controlled by using only an adjacent data range.

More particularly, as illustrated in FIG. 10, an amount of current of a reference block RB may be detected, and amount of currents of an eighth block and a first block may be controlled based on the amount of current of the reference block RB. More specifically, amount of currents of the eighth block and the first block may be controlled to be included in the adjacent data range based on the amount of current of the reference block RB. Further, a separate correction value CV may not be generated in a block, of which an amount of current may satisfy the adjacent data range, and a correction value CV may be generated in a block, of which an amount of current may not satisfy the adjacent data range, so that the amount of current of the block may satisfy the adjacent data range.

An amount of current of a ninth block may be detected based on the amount of currents of the eighth block and the first block, and the amount of current of the ninth block may be controlled to satisfy the adjacent data range (e.g., when the amount of current is controlled, a correction value CV is generated). More specifically, the amount of current of the ninth block may be controlled to satisfy the amount of current of the eighth block, the amount of current of the first block, and the adjacent data range. When the amount of current of the ninth block is controlled, an amount of current of a second block may be controlled to satisfy the adjacent data range based on an amount of current of the first block. Further, an amount of current of a tenth block may be detected based on the amount of currents of the ninth block and the second block, and the amount of current of the tenth block may be controlled to satisfy the adjacent data range.

An amount of current may be controlled up to a $15^{th}$ block while repeating the aforementioned process, and an amount of current of a $23^{th}$ block may be controlled based on the $15^{th}$ block. Amount of currents of the remaining blocks may be controlled based on the $23^{th}$ block while repeating the aforementioned process. Further, amount of current of the blocks may be controlled based on a $64^{th}$ at a lower side of the panel while repeating the aforementioned process.

According to aspects of the invention, it may be possible to control an amount of current deviation by using only the adjacent data range without using a section data range (e.g., a correction value for each block may be generated). Thus, it may be possible to decrease a sensing period of time.

According to exemplary embodiments of the present invention, the panel may be divided into a plurality of blocks and sections, and a current deviation between adjacent blocks and adjacent sections may be reduced. When the current deviation between the adjacent blocks and the adjacent sections is reduced as described above, the panel may display an image with uniform luminance.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. An organic light emitting display device, comprising:

a panel divided into a plurality sections, wherein:

each section comprises a plurality of blocks, each block comprises a plurality of pixels, and the pixels are configured to control an amount of current flowing from a first power source to a second power source via organic light emitting diodes;

a data driver circuit configured to receive bits of data, and generate data signals in response to the bits of data;

a power supply circuit configured to supply the first power source;

a sensing circuit connected to the power supply circuit, and configured to detect an amount of current flowing in each of the blocks; and a timing controller circuit configured to generate a correction value to adjust the bits of data in view of the amount of current.

2. The organic light emitting display device of claim 1, further comprising:

a storing unit configured to store the correction value.

3. The organic light emitting display device of claim 1, wherein the data driver circuit is configured to supply the same data signal to the blocks for a sensing period of time.

4. The organic light emitting display device of claim 1, wherein the timing controller circuit is configured to generate the correction value by referencing a section data range including an allowable current deviation between the sections and an adjacent data range including an allowable current deviation between adjacent blocks.

5. The organic light emitting display device of claim 4, wherein an amount of current of a reference block positioned at a central region of the panel is set as a reference amount of current, and wherein the section data range for a section including the reference block is set to have a predetermined range above and below from the reference amount of current.

6. The organic light emitting display device of claim 5, wherein the predetermined range is set as a range of ±3%.

7. The organic light emitting display device of claim 5, wherein the section data range is set to be decreased according to a section's relative distance from the section including the reference block.

8. The organic light emitting display device of claim 4, wherein the adjacent data range is set to be lower than the section data range.

9. The organic light emitting display device of claim 4, wherein the timing controller circuit is configured to detect a difference in the amount of current between the adjacent blocks based on one or more reference blocks positioned at a central region of the panel, wherein, when the difference in the amount of current satisfies the section data range and the adjacent data range, the timing controller circuit determines not to generate the correction value, and wherein, when the difference in the amount of current does not satisfy at least one of the section data range and the adjacent data range in a target block, the timing controller circuit generates the correction value corresponding to the target block to satisfy the section data range and the adjacent data range.

10. The organic light emitting display device of claim 9, wherein the timing controller circuit is configured to adjust bits of data supplied to the target block by using the correction value for a normal driving period of time, and supply the adjusted data to the data driver circuit.

11. The organic light emitting display device of claim 1, wherein the plurality of blocks includes a first block and a second block, and wherein a number of pixels included in the first block is different from a number of pixels included in the second block.

12. The organic light emitting display device of claim 1, wherein the sensing circuit comprises:

a sensing resistor and a first transistor serially connected between the power supply circuit and the pixels;

a measuring unit connected to both ends of the sensing resistor, and configured to measure the amount of current flowing through the sensing resistor; and a second transistor connected in parallel to the sensing resistor and the first transistor, and disposed between the power supply circuit and the pixels.

13. The organic light emitting display device of claim 12, wherein the first transistor is turned on for a sensing period of time in response to a first control signal, and the second transistor is turned on for a period of time different from the sensing period of time in response to a second control signal.

14. A method of driving an organic light emitting display device including a panel, which is divided into sections including a plurality of blocks, the blocks including one or more pixels, the method comprising:

setting a block among the blocks as a reference block and measuring an amount of current flowing in the reference block;

measuring an amount of current flowing in a target block adjacent to the reference block;

determining whether the amount of current flowing in the target block satisfies a section data range including an allowable current deviation between the sections, and an adjacent data range including an allowable current deviation between the target block and the reference block, wherein, when the amount of current flowing in the target block does not satisfy at least one of the section data range and the adjacent data range, generating a correction value to adjust the amount of current flowing in the target block to satisfy the section data range and the adjacent data range.

15. The method of claim 14, wherein a block positioned at a central region of the panel is set as the reference block.

16. The method of claim 14, wherein an amount of current of the reference block is set as a reference amount of current, and wherein the section data range for a section including the reference block is set to have a predetermined range above and below from the reference amount of current.

17. The method of claim 16, wherein the section data range is set to be decreased according to a section's relative distance from the section including the reference block.

18. The method of claim 14, wherein the adjacent data range is set to be lower than the section data range.

19. The method of claim 14, wherein when the amount of current of the target block is measured, a voltage of a data signal supplied to the target block is adjusted in the target block in response to the correction value.

20. A method of driving an organic light emitting display device including a panel, which has a plurality of blocks including one or more pixels, the method comprising:

setting a block among the blocks as a reference block and measuring an amount of current flowing in the reference block;

measuring an amount of current flowing in a first block spaced apart from the reference block in a first direction, the reference block disposed adjacent to the first block;

measuring an amount of current flowing in a second block spaced apart from the reference block in a second direction different from the first direction, the reference block disposed adjacent to the second block;

determining whether the amount of currents flowing in the first block and the second block satisfy an adjacent data range including an allowable current deviation between adjacent blocks; and when the amount of current of at least one of the first block and the second block does not satisfy the adjacent data range, correcting the amount of current of the at least one of the first block and the second block by generating a correction value and adjusting the current of the at least one of the first block and the second block to satisfy the adjacent data range.

* * * * *